US008391510B2

(12) United States Patent
Vincenot

(10) Patent No.: US 8,391,510 B2
(45) Date of Patent: Mar. 5, 2013

(54) SOUND REPRODUCTION SYSTEM COMPRISING A LOUDSPEAKER ENCLOSURE WITH PORTS, AND ASSOCIATED PROCESSING CIRCUIT

(75) Inventor: Eric Vincenot, Plailly (FR)

(73) Assignee: Nexo, Plailly (FR)

( * ) Notice: Subject to any disclaimer, the term of this patent is extended or adjusted under 35 U.S.C. 154(b) by 193 days.

(21) Appl. No.: 12/670,214

(22) PCT Filed: Jul. 21, 2008

(86) PCT No.: PCT/FR2008/001076

§ 371 (c)(1),
(2), (4) Date: Jan. 22, 2010

(87) PCT Pub. No.: WO2009/043994

PCT Pub. Date: Apr. 9, 2009

(65) Prior Publication Data

US 2010/0202619 A1 Aug. 12, 2010

(30) Foreign Application Priority Data

Jul. 26, 2007 (FR) ..... 07 56759

(51) Int. Cl.
*H04R 1/40* (2006.01)
*H04R 1/20* (2006.01)

(52) U.S. Cl. ..... 381/97; 381/349

(58) Field of Classification Search ..... 381/300, 381/61, 17, 1, 308, 335, 338, 337, 349, 351, 381/345, 97

See application file for complete search history.

(56) References Cited

U.S. PATENT DOCUMENTS 4,462,112 A * 7/1984 Watanabe ..... 381/109
4,472,834 A 9/1984 Yamamuro et al.
5,870,484 A * 2/1999 Greenberger ..... 381/300
7,480,389 B2 1/2009 Ricks et al.
7,519,187 B2 4/2009 Konagai
2002/0125066 A1* 9/2002 Ricks et al. ..... 181/189
2006/0215853 A1* 9/2006 Hiruma et al. ..... 381/97
2010/0220871 A1* 9/2010 Mitsuhashi ..... 381/97

(Continued)

FOREIGN PATENT DOCUMENTS

| | | |
|---|---|---|
| DE | 102 12 083 | 1/2004 |
| EP | 0 847 225 | 6/1998 |
| EP | 1 631 114 | 3/2006 |
| JP | 57068991 A | 4/1982 |
| JP | 3-143195 | 6/1991 |
| JP | 2004363697 A | 12/2004 |
| JP | 2006191285 A | 7/2006 |
| WO | 02/073435 | 9/2002 |

OTHER PUBLICATIONS

International Search Report dated Feb. 23, 2009, from corresponding PCT application.

(Continued)

*Primary Examiner* — Xu Mei
*Assistant Examiner* — David Ton
(74) *Attorney, Agent, or Firm* — Young & Thompson

(57) ABSTRACT

A sound reproduction system includes a loudspeaker enclosure that has a first loudspeaker and a second loudspeaker which are mounted on a surface of the enclosure. The first and second loudspeakers are respectively accommodated in a first space and a second space of the enclosure, the spaces being separated by a partition and being in communication with a first port and a second port, respectively. The first and second ports are located on opposite sides of the unit formed by the first and second loudspeakers. Processing elements are used for respectively applying a first and a second electric signal to the first and second loudspeaker, the first and second electric signals being generated from a single signal by differentiated phase processing that varies according to the frequency such that the first and second electric signals are offset relative to one another by a variable period of time which is proportionate to the acoustic distance between the first half of the loudspeaker enclosure including the first space, the first loudspeaker, and the first port, and the second half of the loudspeaker enclosure including the second space, the second loudspeaker, and the second port.

18 Claims, 8 Drawing Sheets

OTHER PUBLICATIONS

"Forward Steered Arrays in Precision Directivity Speaker Systems", Technical Notes, Aug. 2001, pp. 1-12, vol. 1, No. 28, JBL Professional, Northridge, CA.

"Precision Directivity PD700 and PD100", Installation Products, Harman Pro Catalog.

Translation of Japanese Office Action, dated Jan. 24, 2012, from corresponding JP application.

* cited by examiner

SOUND REPRODUCTION SYSTEM COMPRISING A LOUDSPEAKER ENCLOSURE WITH PORTS, AND ASSOCIATED PROCESSING CIRCUIT

The present invention concerns a sound reproduction system comprising a loudspeaker enclosure with ports, usually called a bass-reflex loudspeaker enclosure.

In sound reproduction systems, in some cases increased directionality of the reproduced acoustic wave is required, which concentrates the radiated acoustic energy in a particular direction, generally toward the public for whom the reproduction is intended.

A standard technique for increasing directionality is to cause interference between two omnidirectional sources in phase opposition and spaced apart by a distance d by introducing a delay $\tau$ on one of the sources corresponding to the time taken by sound to travel the distance d between the sources.

Accordingly, in a certain frequency range, the acoustic signals emitted by the two sources interfere constructively on the axis of the two sources in front of the source with no delay) (0°) but cancel each other out on the axis of the two sources to the rear of the delayed source) (180°). In other directions the radiated pressure decreases in inverse proportion to the angle formed with the front direction and the radiation polar diagram is consequently cardioid.

Based on the same principle, using a delay $\tau$ less than the time taken by sound to travel the distance d between the sources leads to directionality of hypercardioid type; in the extreme case, a zero delay leads moreover to directionality of bidirectional type. Conversely, a delay $\tau$ greater than the time taken by sound to travel the distance d between the sources leads to directionality of infracardioid type (a very long delay $\tau$ even leading to directionality of omnidirectional type).

Control of directionality is nevertheless obtained over only a limited frequency range. Below a frequency $f_1$ determined by the spacing between the sources and the delay applied, adding a second source reduces the pressure radiated on the axis although the directionality function is preserved. Above a certain frequency $f_2$, adding a second source leads to a reduction in the pressure radiated on the axis and progressive deformation of the directionality function. In the case of a cardioid directionality function, the distance between the frequencies $f_1$ and $f_2$ is 2.3 octaves, which represents the usable operating range of the device (see dashed line curve in FIG. 11).

Also known are loudspeaker enclosures with ports or bass-reflex type loudspeaker enclosures. The particular feature of loudspeaker enclosures of this type is to use one or more ports to increase the efficiency of radiation at the lowest frequencies compared to an infinite baffle loudspeaker enclosure.

Thus the bass-reflex loudspeaker enclosure has at least two radiating surfaces: the port or ports, radiating at around the tuned frequency $f_C$ of the loudspeaker enclosure (curve EV), and the loudspeaker, the radiation from which exceeds that of the port or ports beyond a contribution limit frequency $f_L$ (curve HP), as represented in FIG. 13. These two frequencies $f_C$ and $f_L$ are determined by the length of the port or ports, the area of the port or ports, and the volume of air contained in the loudspeaker enclosure.

Moreover, as can be seen in FIG. 14, above the tuned frequency $f_C$, the loudspeaker radiates in phase with the port; below the tuned frequency $f_C$, the loudspeaker radiates in phase opposition with the port.

In this context, the invention is directed to a sound reproduction system comprising a loudspeaker enclosure with ports in which in particular increased directionality can be obtained and an increase in the pressure on the axis by adding a second source over a greater frequency range than referred to above and by relatively simple means.

The invention therefore proposes a sound reproduction system comprising a loudspeaker enclosure provided with a first loudspeaker and a second loudspeaker mounted on one face of the enclosure, the first loudspeaker and the second loudspeaker being respectively received in a first volume of the loudspeaker enclosure and in a second volume of the loudspeaker enclosure separated by a partition and respectively discharging via a first port and a second port, the first port and the second port being situated on respective opposite sides of the combination formed by the first loudspeaker and the second loudspeaker, characterized by processing means adapted to apply respectively to the first loudspeaker and to the second loudspeaker a first electrical signal and a second electrical signal obtained from the same signal by differentiated phase processing varying with frequency, such that the first electrical signal and the second electrical signal are offset by a varying time (at least substantially) proportional to the acoustic distance between the first half-enclosure, including the first volume, the first loudspeaker and the first port, and the second half-enclosure, including the second volume, the second loudspeaker and the second port.

To obtain a cardioid radiation diagram, the differentiated processing can be such that the first electrical signal and the second electrical signal are in phase opposition and offset by a time corresponding to the acoustic distance between the first half-enclosure, including the first volume, the first loudspeaker and the first port, and the second half-enclosure, including the second volume, the second loudspeaker and the second port, over at least a frequency range including the tuned frequency of the ports and the contribution limit frequency of the loudspeakers.

To obtain a hypercardioid diagram, the differentiated processing can be such that the first electrical signal and the second electrical signal are in phase opposition and offset by a time corresponding to one third of the acoustic distance between the first half-enclosure, including the first volume, the first loudspeaker and the first port, and the second half-enclosure, including the second volume, the second loudspeaker and the second port.

To obtain an infracardioid diagram, the differentiated processing can be such that the first electrical signal and the second electrical signal are in phase opposition and offset by a time corresponding to three times the acoustic distance between the first half-enclosure, including the first volume, the first loudspeaker and the first port, and the second half-enclosure, including the second volume, the second loudspeaker and the second port.

Alternatively, the differentiated processing can be such that the first electrical signal and the second electrical signal are in phase and offset by a time corresponding to the acoustic distance between the first half-enclosure, including the first volume, the first loudspeaker and the first port, and the second half-enclosure, including the second volume, the second loudspeaker and the second port. The sound level is then increased on the axis of the sources on the delayed source side.

It is observed that, in the situations just referred to, the delay generated by the offset is introduced either between two signals in phase (in which case the sound level is increased on the axis of the sources on the delayed source side) or between two signals in phase opposition, one having the opposite polarity to the other (in which case the sound level is increased on the axis of the sources on the side opposite the delayed source).

Clearly the expression "in phase and offset" must be understood as meaning that the offset is applied to signals in phase (which could be expressed as "in phase and then offset") and that the signals resulting from the offset are therefore not a priori in phase. Similarly, the expression "in phase opposition and offset" means that the offset is introduced between signals in phase opposition (which could be expressed as "in phase opposition and then offset" even if the phase opposition and the offset can be introduced by the same delay operation as specified hereinafter).

The phase opposition between the two signals can be obtained by reversing the electrical terminals of one of the two loudspeakers or by introducing into one of the two signals a delay equal to a half-period.

The differentiated processing is generally such that the direction of maximum radiation efficiency is along the axis formed by the first loudspeaker and the second loudspeaker. The axis formed by the first loudspeaker and the second loudspeaker is therefore generally directed toward an audience area to be covered.

In one embodiment, the processing means are adapted selectively to apply an identical electrical signal to the first loudspeaker and to the second loudspeaker in a first mode of operation and the first electrical signal and the second electrical signal obtained by differentiated processing in a second mode of operation. It is thus possible to alternate between an essentially omnidirectional mode of operation and a directional mode of operation.

In practice the first loudspeaker and the second loudspeaker can be identical and the first volume and the second volume can be symmetrical with respect to the partition.

According to beneficial features described in detail hereinafter, the first loudspeaker and the second loudspeaker are at a first distance, the first port and the second port are at a second distance and the ratio of the second distance to the first distance is between 2 and 3 inclusive. In particular, the ratio can be between 2.2 and 2.5 inclusive.

To receive the signals processed in a differentiated way, the loudspeaker enclosure comprises a first pair of connecting points electrically connected to the first loudspeaker and a second pair of connecting points electrically connected to the second loudspeaker and the processing means are adapted to apply respectively the first electrical signal to the first pair of connecting points and the second electrical signal to the second pair of connecting points.

In practice, the processing means comprise, for example, a filter the phase transfer function of which is such that it generates a delay varying with frequency and substantially corresponding to the acoustic distance between the first half-enclosure, including the first volume, the first loudspeaker and the first port, and the second half-enclosure, including the second volume, the second loudspeaker and the second port.

The invention further proposes a processing circuit adapted to apply a first electrical signal to a first loudspeaker mounted with a second loudspeaker on a wall of a loudspeaker enclosure having a first volume and a second volume separated by a partition, respectively receiving the first loudspeaker and the second loudspeaker, and each respectively communicating with a first port and a second port situated on respective opposite sides of the combination formed by the first loudspeaker and the second loudspeaker, characterized by processing means adapted to apply respectively to the first loudspeaker and to the second loudspeaker a first electrical signal and a second electrical signal obtained from the same signal by differentiated phase processing varying with frequency, such that the first electrical signal and the second electrical signal are offset by a varying time (at least essentially) proportional to the acoustic distance between the first half-enclosure, including the first volume, the first loudspeaker and the first port, and the second half-enclosure, including the second volume, the second loudspeaker and the second port.

This processing circuit can equally include some of the optional features referred to above in relation to the sound reproduction system.

Other features and advantages of the invention will become more apparent in the light of the following description, given with reference to the appended drawings, in which:

FIG. 1 represents in front view a loudspeaker enclosure of a system conforming to the teachings of the invention;

FIG. 2*a* represents a view of the loudspeaker enclosure from FIG. 1 in section taken along the line II-II;

FIGS. 2*b* and 2*c* show alternate ways to produce the ports of the loudspeaker enclosure from FIG. 2*a;*

Figure 1:
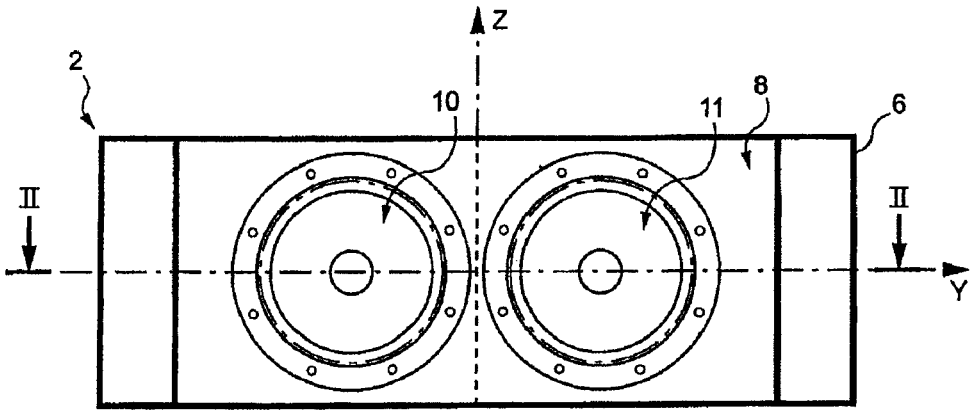
Figure 12A:
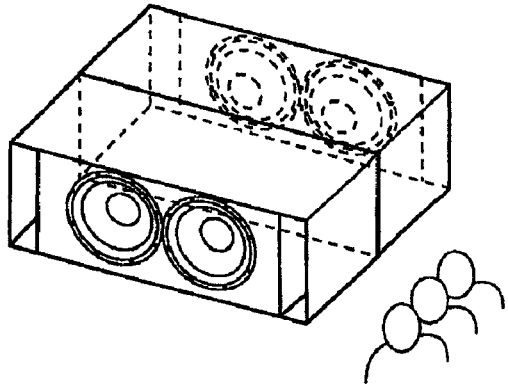
Figure 12B:
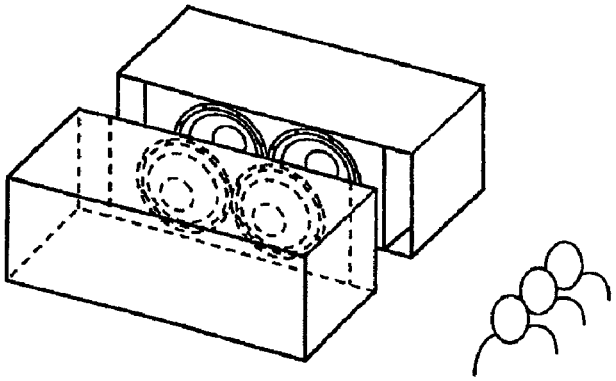
Figure 12C:
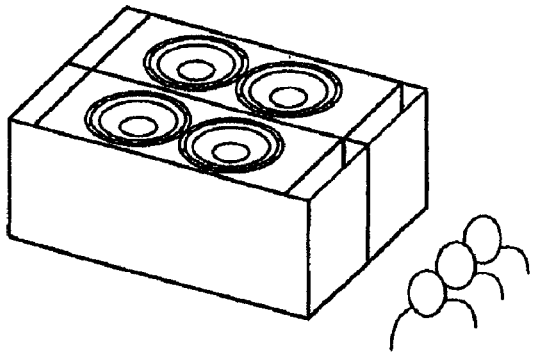
Figure 12D:
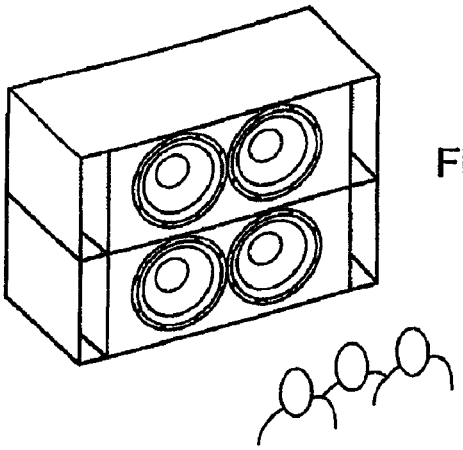
Figure 13:
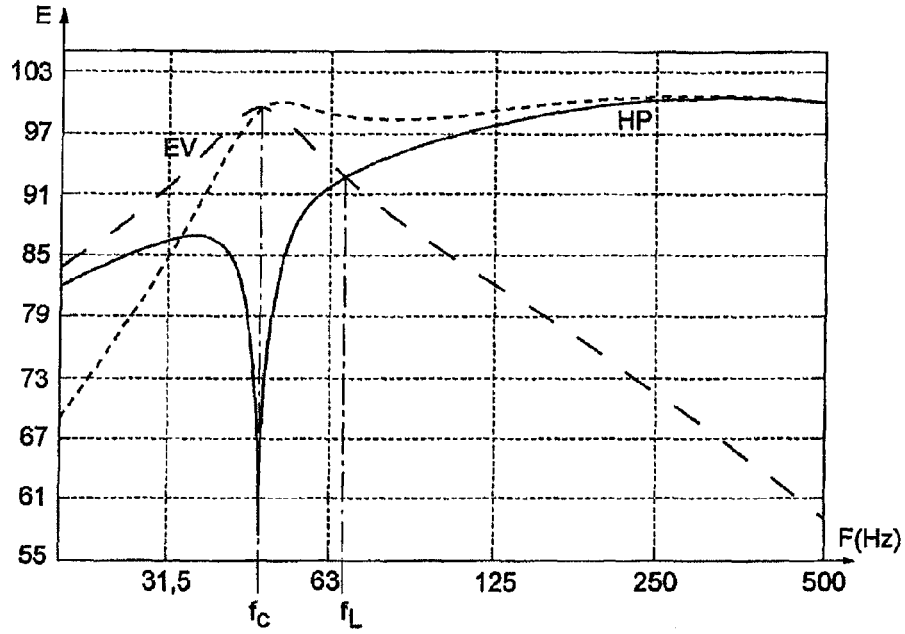
Figure 14:
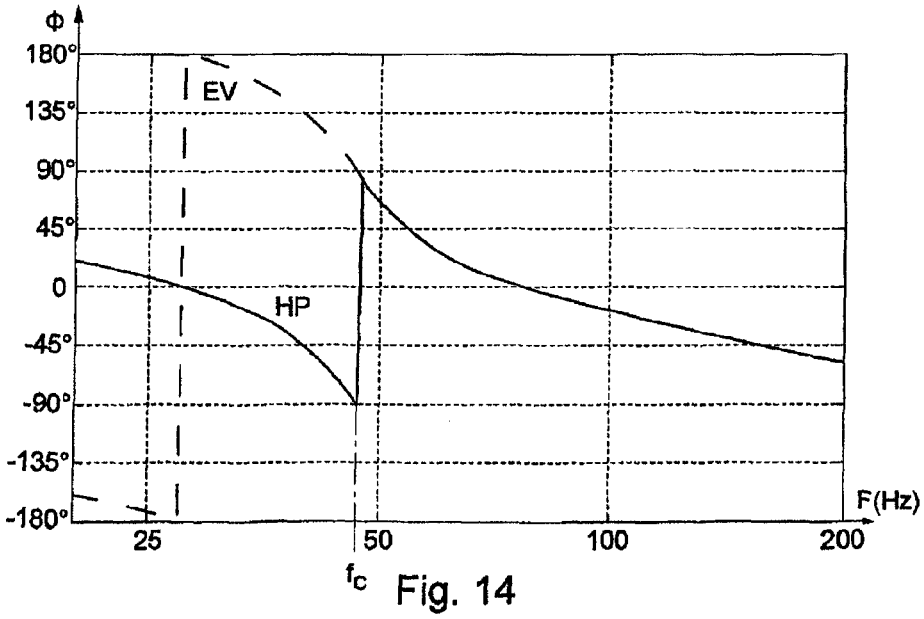

FIGS. 12*a* to 12*c* represent different types of assembly that can be envisaged for loudspeaker enclosures of the type represented in FIG. 1 in a directional radiation mode;

FIG. 12*d* represents an assembly that can be envisaged for loudspeaker enclosures of the type represented in FIG. 1 in an omnidirectional mode;

FIG. 13 represents the amplitude response curve as a function of frequency for a bass-reflex loudspeaker enclosure;

FIG. 14 shows the phase response curve as a function of frequency for the same type of loudspeaker enclosure.

Figure 2A:
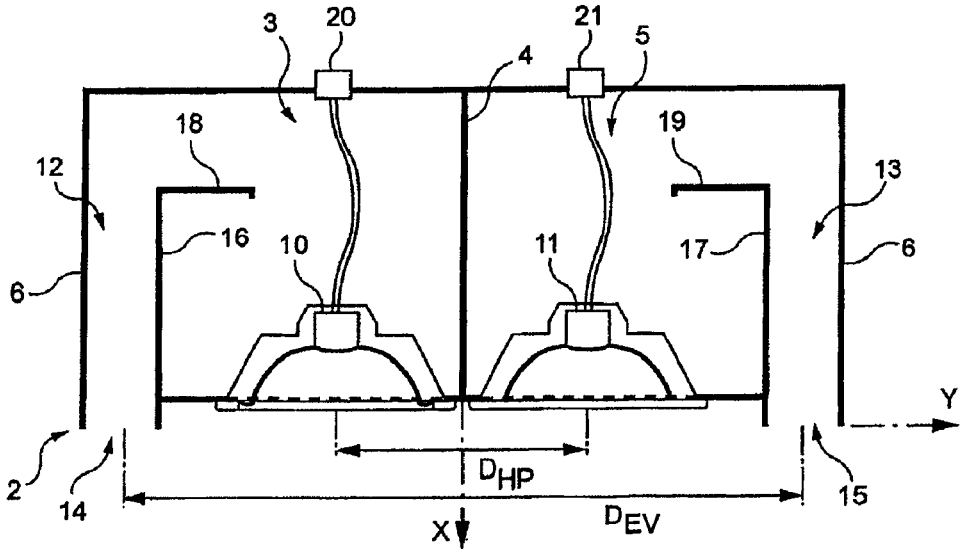

There is described hereinafter an example of a sound reproduction system conforming to the teachings of the invention that includes a loudspeaker enclosure represented in FIGS. 1 and 2*a* and a processing circuit shown in FIG. 4.

The loudspeaker enclosure represented in FIGS. 1 and 2 is a bass-reflex type loudspeaker enclosure 2 of parallelepipedal general shape divided into two symmetrical half-enclosures 3, 5 by an internal partition 4 essentially parallel to its outside lateral walls 6. Such a loudspeaker enclosure 2 is particularly suitable for forming a subwoofer.

Two separate loudspeaker enclosures combined to obtain a structure of the same type as that described here could be used instead.

On a wall of a front face distinct from the lateral walls 6, the loudspeaker enclosure carries two loudspeakers 10, 11 situated on respective opposite sides of the internal partition 4 and consequently each occupying one of the two half-enclosures 3, 5.

Note that in the example described here the front face 8 is that delimited by the longer side and the shorter side of the parallelepiped that is the general form of the loudspeaker enclosure 2.

The loudspeakers 10, 11 are mounted on the front face 8 so that their principal emission direction is essentially perpendicular to the front face 8 and directed toward the exterior of the loudspeaker enclosure. This direction is by convention referred to as the X direction.

The loudspeakers 10, 11 are identical here and aligned with an axis Y situated in the plane of the front face 8 and essentially parallel to the longest side of the loudspeaker enclosure 2.

The loudspeakers 10, 11 are moreover almost juxtaposed in the direction Y of their alignment with the result that the distance $D_{HP}$ separating the two loudspeakers 10, 11 (i.e. their respective centers where their diaphragm is situated) is relatively small, here hardly greater than the outside diameter of the loudspeakers perpendicularly to the direction X.

The loudspeaker enclosure 2 described here moreover has a short side (direction Z that with the direction Y defines the plane of the front face 8) the dimension of which is hardly greater than the diameter of the loudspeakers.

Each half-enclosure 3, 5 includes a pipe 12, 13 situated opposite the internal partition 4 in each half-enclosure 3, 5 and each opening into a port 14, 15 formed in the front face 8 of the loudspeaker enclosure 2. Alternatively, the ports could equally well open onto the sides.

Each port 14, 15 extends over the full height (in the direction Z) of the loudspeaker enclosure and is situated at the periphery of the front face 8 in the direction Y.

Other shapes and arrangements can naturally be envisaged for the ports; they can be circular, for example.

The ports 14, 15 are thus aligned with the loudspeakers 10, 11 but situated on respective opposite sides of the combination of the two loudspeakers 10, 11. The distance $D_{EV}$ between the ports 14, 15 is consequently greater than the distance $D_{HP}$ between the loudspeakers. As explained hereinafter, the ratio $D_{EV}/D_{HP}$ of these distances is generally between 2 and 3 inclusive, and preferably between 2.2 and 2.5 inclusive, to obtain the maximum benefit of the effect described hereinafter (and which in theory is greatest for a ratio of 2.3).

In the example described here: $D_{EV}$=96 cm and $D_{HP}$=43 cm.

Each pipe 12, 13 is formed between the external lateral wall 6 concerned and an internal wall 16, 17 the general direction of which is parallel to the external lateral walls 6.

Each internal wall 16, 17 terminates at its end opposite the front face 8 in an extension 18, 19 essentially parallel to the rear face of the loudspeaker enclosure 2.

Figure 2B:
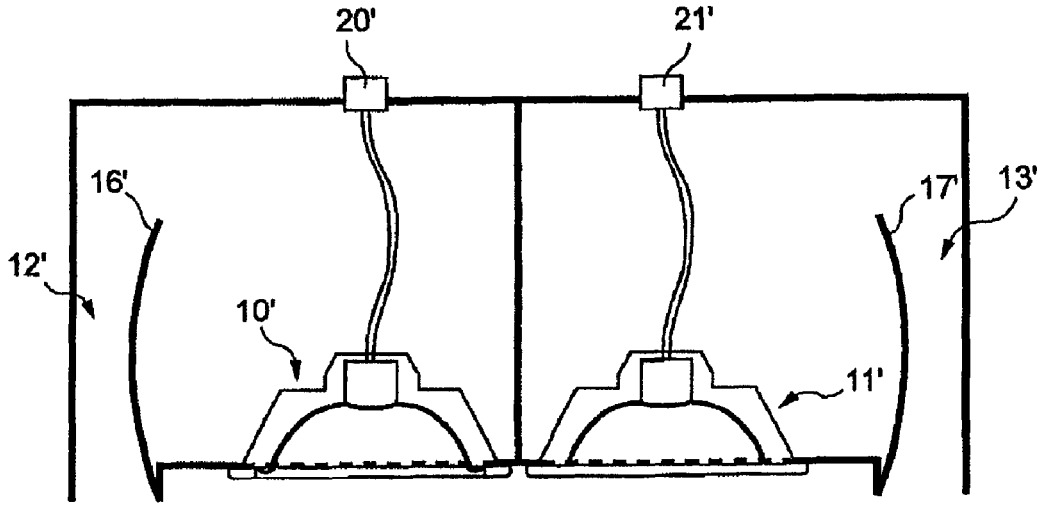
Figure 2C:
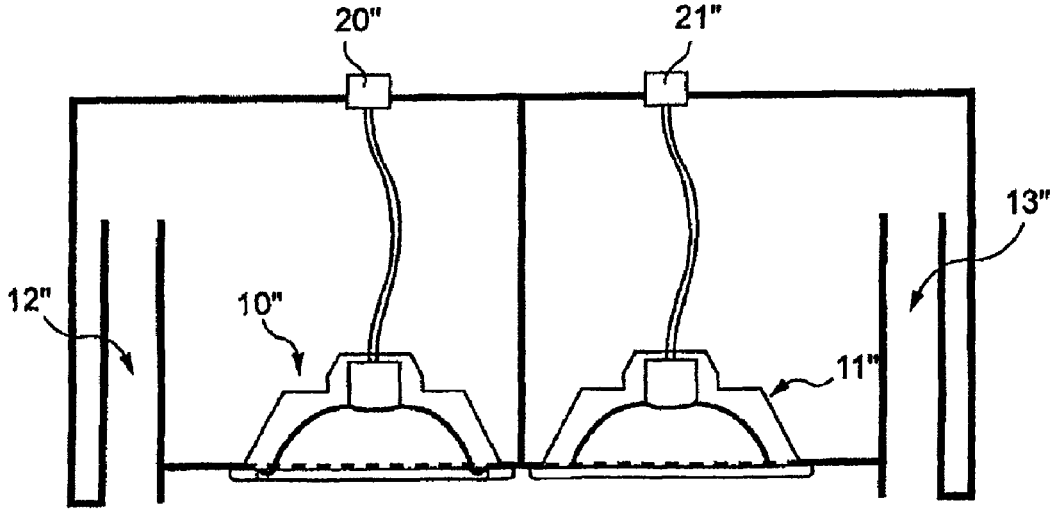

Alternatively, the ports 14, 15 can be produced differently, for example by means of plastic material tubes 12", 13" (FIG. 2*c*) or profiled panels 16', 17' (FIG. 2*b*). (In FIGS. 2*b* and 2*c*, elements similar to those of FIG. 2*a* carry the same references plus the symbols "and", respectively).

Each half-enclosure 3, 5 thus forms a bass-reflex type system the port 14, 15 of which radiates at around the tuned frequency $f_C$ determined by the area of the port, the length of the port and the volume of the loudspeaker enclosure, the loudspeaker of which radiates mainly above a contribution limit frequency $f_L$ above the tuned frequency $f_C$.

Because of the symmetrical construction of the two half-enclosures 3, 5 with respect to the partition 4 and the use of identical loudspeakers 10, 11, the two ports 14, 15 and the two loudspeakers 10, 11 have a common tuned frequency $f_C$ and a common contribution limit frequency $f_L$.

At a position on the axis linking the two loudspeakers, the acoustic distance $D_A(f)$ between the rear half-enclosure 3 and the front half-enclosure 5 corresponds to the phase difference between the pressures generated by these two half-enclosures in this direction, which difference is expressed in the form of a distance equivalent to this difference for the acoustic wave. This phase difference is varying as a function of the frequency concerned.

The relation between the acoustic distance $D_A(f)$ and the phase difference $\Delta\phi(f)$ is therefore given by the equation:

$$D_A(f) = \frac{\Delta\varphi(f)C}{2\pi f}$$

where C is the speed of sound in air (in m/s) and f is the envisaged frequency (in Hz).

The time corresponding to the acoustic distance is consequently:

$$\tau_A(f) = \frac{\Delta\varphi(f)}{2\pi f}.$$

The acoustic distance thus combines the physical distance between the half-enclosures and the effects linked to the phase relationships between the sources, and thus depends on:

the distance between the ports 14, 15;

the tuned frequency $f_C$ of the port;

the distance between the loudspeakers 10, 11;

the contribution limit frequency $f_L$ of the loudspeaker;

the phase relationship between port and loudspeaker specific to the bass-reflex type loudspeaker enclosure.

Figure 3:
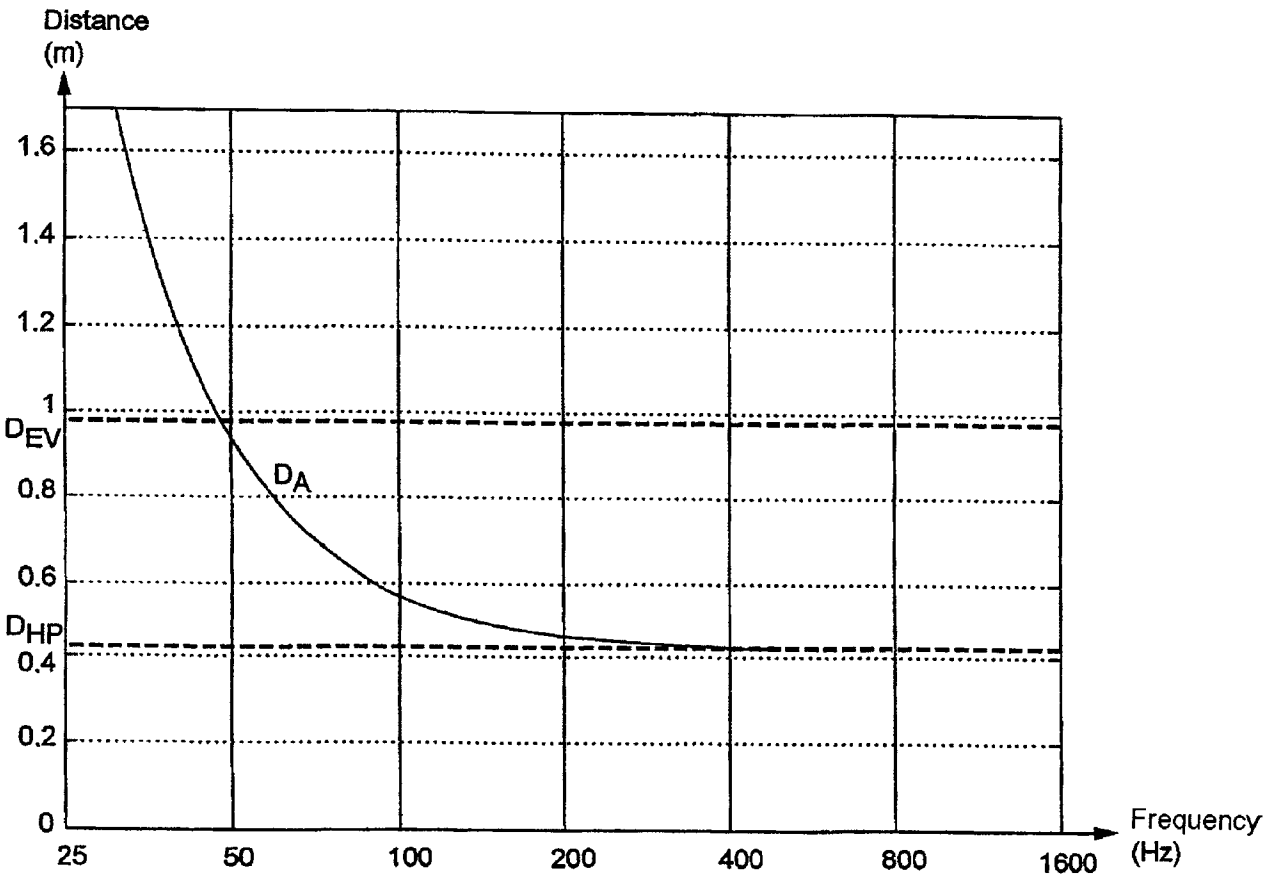
FIG. 3 represents the acoustic distance between two bass-reflex type systems.

Consequently, as represented in FIG. 3, below the tuned frequency $f_C$ of the bass-reflex loudspeaker enclosure, the acoustic distance between the rear half-enclosure and the front half-enclosure is equal to the distance $D_{EV}$ between ports increased by a distance induced by the phase opposition between ports and loudspeakers.

At the tuned frequency $f_C$, the acoustic distance is equal to the physical distance $D_{EV}$ between the ports.

Between the tuned frequency $f_C$ and the contribution limit frequency $f_L$ of the loudspeaker, the acoustic distance decreases from the physical distance $D_{EV}$ between the ports to the physical distance $D_{HP}$ between the loudspeakers.

Beyond the loudspeaker contribution limit frequency $f_L$, the acoustic distance tends toward an asymptote equal to the physical distance $D_{HP}$ between the loudspeakers.

The loudspeaker enclosure 2 finally includes two connectors (that constitute pairs of connection points) 20, 21, each connector being electrically connected to a single loudspeaker 10, 11.

Figure 4:
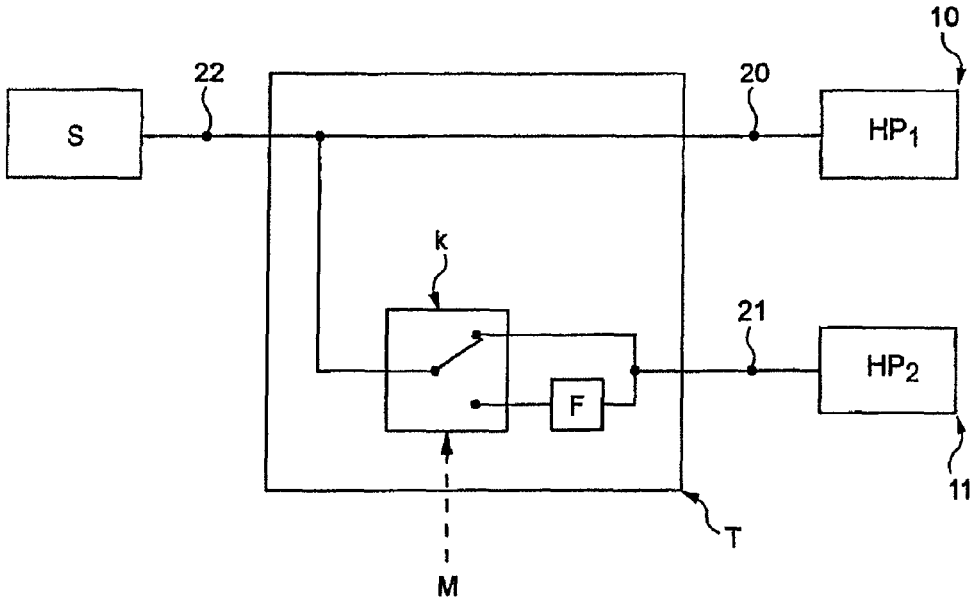
FIG. 4 represents diagrammatically the principal elements for processing electrical signals applied to the loudspeakers of the loudspeaker enclosure from FIG. 1.

The sound reproduction system also includes a processing circuit T the main elements of which are represented in FIG. 4.

The processing circuit T receives an electrical signal defining the acoustic signal to be emitted from a source S via a connector 22.

The processing circuit T connects the input connector 22 directly to a first output connector intended to be connected to the connector 20 connected to a first of the two loudspeakers of the enclosure 2 (for example the loudspeaker 10).

By way of an electrical circuit described hereinafter, the processing circuit T also connects the input connector 22 to a second output connector intended to be connected to the connector 21 of the second loudspeaker 11.

The aforementioned electrical circuit includes a controlled switch K that receives as input the electrical signal coming from the source S via the input connector 22 and is selectively able, as a function of information M designating the operating mode, to apply this signal to a first output of the switch K connected directly to the second output connector or to a second output of the switch K connected to the second output connector via a filter F the characteristics of which are described hereinafter.

In a first mode of operation, the switch K is controlled by the information M (for example manually or by logic) so as to connect electrically the input connector 22 of the processing circuit T to the second output connector of the processing circuit T.

Accordingly, in this mode of operation, the two loudspeakers 10, 11 receive identical signals (namely the signal sent by the source here). According to one variant that can be envisaged, it is naturally possible to provide additional processing for the electrical signal received from the source S, although such treatment nevertheless does not lead in this first mode of operation to any difference between the signals fed to the two loudspeakers 10, 11.

Figure 5:
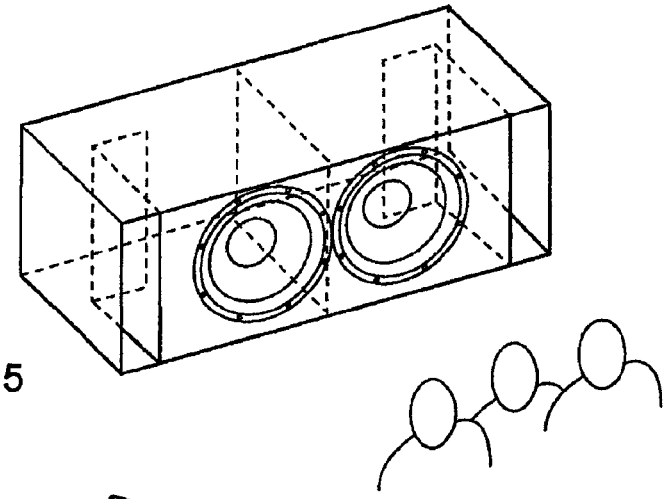
FIG. 5 represents the loudspeaker enclosure from FIG. 1 facing toward the public in an omnidirectional radiation mode.
Figure 8:
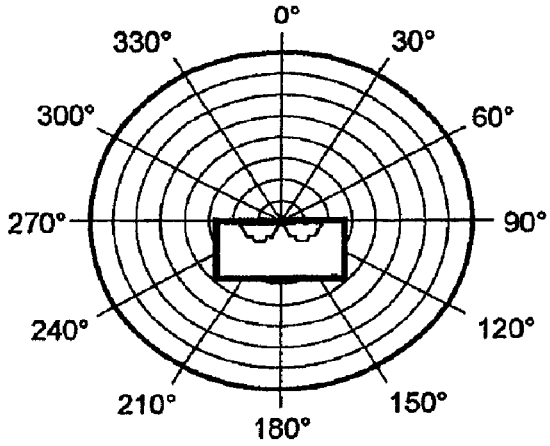
FIG. 8 is a polar diagram of the radiation from the loudspeaker enclosure in the omnidirectional radiation mode.

The two loudspeakers and the two ports then each emit identical acoustic waves reproducing the signals generated by the source S, in particular above the contribution limit frequency $f_L$ of the loudspeakers, respectively around the tuned frequency $f_C$ of the loudspeaker enclosure, globally toward the front of the enclosure (the direction X defined above), but with no particular control of directionality, as represented diagrammatically in FIG. 8. The loudspeaker enclosure is therefore generally disposed relative to the audience as represented in FIG. 5.

In a second mode of operation, the switch K connects the input connector 22 to the second output connector 21 via the filter F. This filter F on the one hand reverses the polarity of the signal and on the other hand generates a delay function $\tau(f)$ varying with the frequency of the processed signal to compensate as much as possible the acoustic distance between the two half-enclosures, according to the equation $\tau(f)=D_A/C$ where C is the speed of sound.

A simple analog filter of the all-pass phase-shifter type can be used for this, for example, the transfer function of which is expressed as follows:

$$H(f) = \frac{1 - j \cdot f / f_0}{1 + j \cdot f / f_0}$$

in which j is the imaginary unit (square root of −1) and f is the frequency, and where $f_0$ is chosen to approximate optimally the required variable delay function $\tau(f)$.

For improved efficiency and better control of directionality, a finite impulse response (FIR) filter can be used instead, the phase transfer function of which (independent of the amplitude transfer function for this type of filter) is defined to equal the delay function $\tau(f)$ required as indicated above.

Figure 9:
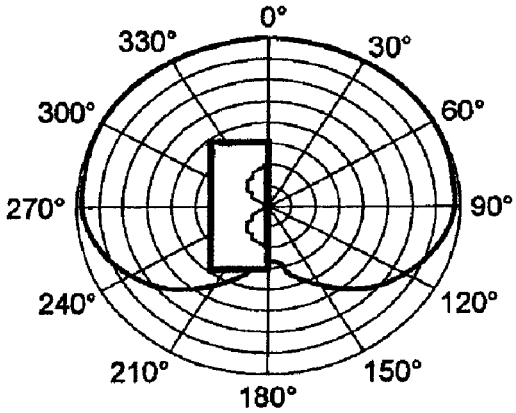
FIG. 9 is a polar diagram of the radiation from the loudspeaker enclosure in the directional radiation mode of FIG. 6.
Figure 10:
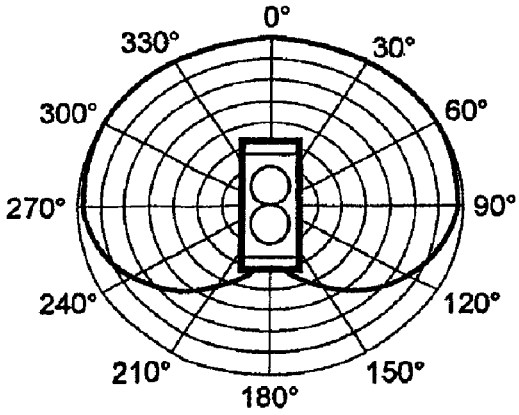
FIG. 10 is a polar diagram of the radiation from the loudspeaker enclosure in the directional radiation mode from FIG. 7.

As shown in FIGS. 9 and 10, in this second mode of operation there is therefore a system in which the two loudspeakers 10, 11 radiate with cardioid directionality on the axis of the loudspeakers (axis Y as defined above) above the contribution limit frequency $f_L$ of the loudspeakers and with the same cardioid directionality on the same axis Y connecting the ports 14, 15 around the tuned frequency $f_C$ of the port, in both cases over a frequency range of 2.3 octaves.

The frequency range in which directionality on the axis Y is obtained with increased efficiency on the axis is therefore much greater than that obtained with standard techniques.

A distance ratio $D_{EV}/D_{HP}$ between the distance $D_{EV}$ between the ports 14, 15 and the distance $D_{HP}$ between the loudspeakers 10, 11 is preferably used, having a maximum value of the order of 2.3 (the ratio has the exact value 2.3 in the embodiment described here) so that there is no interruption between the range of good directionality situated around the tuned frequency $f_C$ and the range of good directionality situated above the contribution limit frequency $f_L$.

Figure 11:
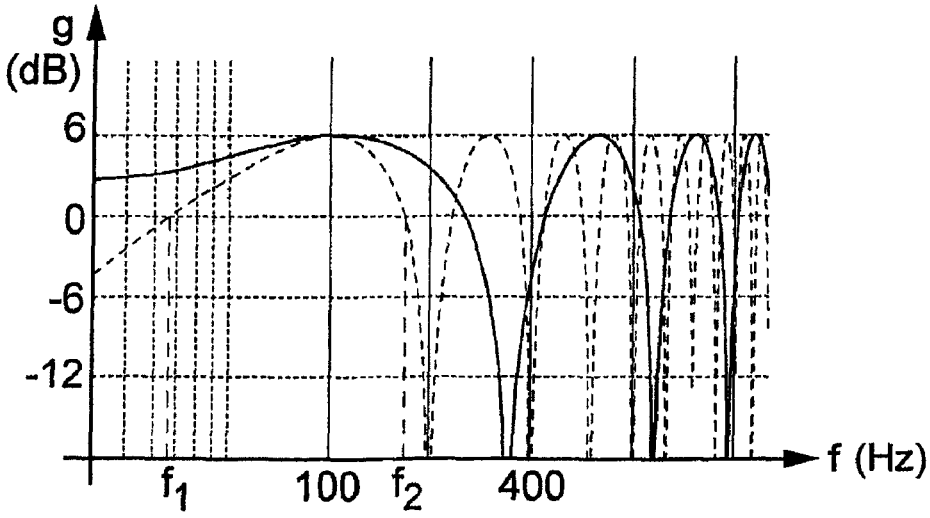
FIG. 11 represents the gain on the axis caused by the presence of a second source in the case of the system of the invention and in the case of a conventional system.

In the example described here a positive gain is obtained by adding a second source over a particularly wide frequency range, as can clearly be seen in FIG. 11, where the solid line curve represents the gain induced by adding the second source as a function of frequency in the system that has just been described (the dashed line representing the gain induced by adding a second source in the conventional situation described in the introduction).

Figure 6:
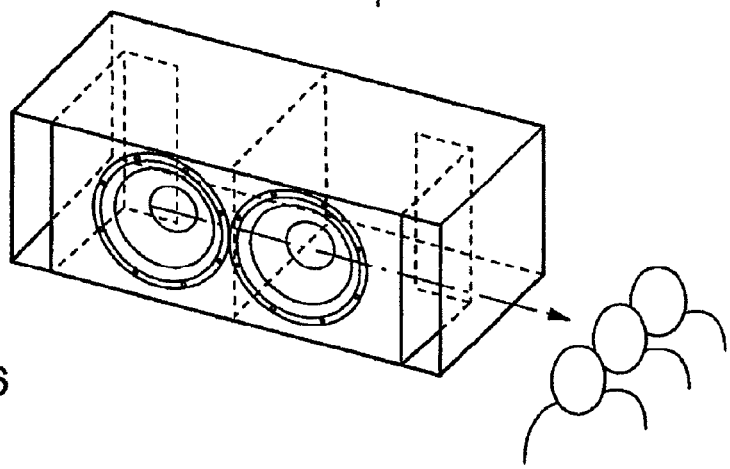
FIG. 6 shows the loudspeaker enclosure turned 90°, with the loudspeakers on the side, in a directional radiation mode.
Figure 7:
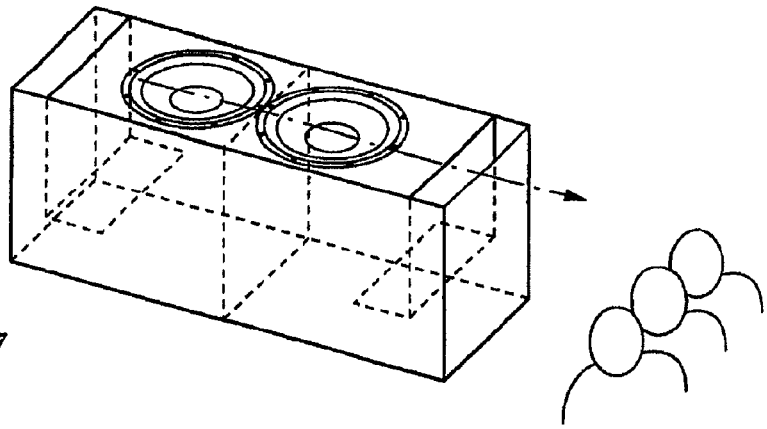
FIG. 7 represents the loudspeaker enclosure turned 90°, with the loudspeakers on the top, in a directional radiation mode.

It is understood that in this second mode of operation the loudspeaker enclosure 2 is used turned 90°, i.e. with the direction Y defined above directed toward the public, as shown in FIG. 6. In this figure, the wall that carries the loudspeakers is vertical (loudspeakers on the side) but the loudspeaker enclosure could equally well be disposed with the loudspeakers facing upward, as represented in FIG. 7, or downward (the important point being that the axis defined by the alignment of the loudspeakers is directed toward the audience).

Disposing the ports on respective opposite sides of the loudspeakers is particularly beneficial because the distance between ports makes a gain possible by adding the second source over a range of low frequencies, while the distance between loudspeakers makes possible a gain and a control of directionality without deformation by adding a second source over a range of relatively higher frequencies, in correspondence with the conventional frequency positioning of these elements.

The invention is naturally not limited to the embodiment that has just been described.

Other embodiments favor the efficiency of the device on the axis in front of the delayed source to the detriment of directional control by delaying one of the two sources according to the delay function $\tau(f)$ without reversing the polarity of either of the two electrical signals.

It is moreover possible as shown in FIGS. 12*a* to 12*c* to assemble a plurality of loudspeaker enclosures operating in accordance with the principle that has just been described, and in varied configurations: for example, FIG. 12*a* shows two loudspeaker enclosures back to back (i.e. each disposed as in FIG. 6, the loudspeakers of each loudspeaker enclosure facing away from the other enclosure), in FIG. 12*b* two loudspeaker enclosures face to face (i.e. each disposed as in FIG. 6, with the loudspeakers of each loudspeaker enclosure directed toward the other loudspeaker enclosure, here with a spacing of half the enclosure depth between the loudspeaker enclosures), and in FIG. 12*c* two loudspeaker enclosures side by side (i.e. each disposed as in FIG. 7, and in contact through a lateral wall). (FIG. 12*d* represents the assembly of two loudspeaker enclosures in omnidirectional mode).

The invention claimed is:

1. A sound reproduction system comprising:

a loudspeaker enclosure (2) provided with a first loudspeaker and a second loudspeaker mounted on one face of the enclosure, the first loudspeaker and the second loudspeaker being respectively received in a first volume of the loudspeaker enclosure and in a second volume of the loudspeaker enclosure separated by a partition and respectively discharging via a first and a second port, the first port and the second port being situated on respective opposite sides of the combination formed by the first loudspeaker and the second loudspeaker; and processing means for applying respectively to the first loudspeaker and to the second loudspeaker a first electrical signal and a second electrical signal obtained from a same signal by differentiated phase processing varying with frequency, the processing means generating, between the first electrical signal and the second electrical signal a delay varying with frequency and proportional to an acoustic distance between the first half-enclosure, including the first volume, the first loudspeaker and the first port, and the second half-enclosure, including the second volume, the second loudspeaker and the second port, wherein the acoustic distance is larger than a first distance between the first loudspeaker and the second loudspeaker and smaller than a second distance between the first port and the second port over a frequency range from a tuned frequency of the first and second ports to a contribution limit frequency of the first and second loudspeakers.

2. The sound reproduction system according to claim 1, wherein the differentiated phase processing is such that the first electrical signal and the second electrical signal are in phase opposition and offset by the delay, the delay being equal to the ratio between the acoustic distance and the speed of sound.

3. The sound reproduction system according to claim 1, wherein the differentiated phase processing is such that the first electrical signal and the second electrical signal are in phase opposition and offset by the delay, the delay corresponding to one third of said acoustic distance.

4. The sound reproduction system according to claim 1, wherein the differentiated phase processing is such that the first electrical signal and the second electrical signal are in phase opposition and offset by the delay, the delay corresponding to three times said acoustic distance.

5. The sound reproduction system according to claim 1, wherein the differentiated phase processing is such that the first electrical signal and the second electrical signal are in phase and offset by the delay, which corresponds a time corresponding to the acoustic distance.

6. The sound reproduction system according to claim 1, wherein the differentiated phase processing is such that the direction of maximum radiation efficiency is directed along the axis (Y) formed by the first loudspeaker and the second loudspeaker.

7. The sound reproduction system according to claim 1, wherein the axis formed by the first loudspeaker and the second loudspeaker is directed toward an audience area to be covered.

8. The sound reproduction system according to claim 1, wherein the processing means are adapted selectively to apply (K) an identical electrical signal to the first loudspeaker and to the second loudspeaker in a first mode of operation and the first electrical signal and the second electrical signal obtained by differentiated processing in a second mode of operation.

9. The sound reproduction system according to claim 1, wherein the first loudspeaker and the second loudspeaker are identical and wherein the first volume and the second volume are symmetrical with respect to the partition.

10. The sound reproduction system according to claim 1, wherein the first loudspeaker and the second loudspeaker are at a first distance ($D_{HP}$), the first port and the second port are at a second distance ($D_{EV}$) and the ratio of the second distance to the first distance is from 2 to 3.

11. The sound reproduction system according to claim 10, wherein the ratio is from 2.2 to 2.5.

12. The sound reproduction system according to claim 1, wherein the loudspeaker enclosure comprises a first pair of connecting points electrically connected to the first loudspeaker and a second pair of connecting points electrically connected to the second loudspeaker and wherein the processing means apply respectively the first electrical signal to the first pair of connecting points and the second electrical signal to the second pair of connecting points.

13. The sound reproduction system according to claim 1, wherein the processing means comprise a filter, wherein the filter transfer function generates a delay varying with frequency and substantially corresponding to the acoustic distance between the first half-enclosure, including the first volume, the first loudspeaker and the first port, and the second half-enclosure, including the second volume, the second loudspeaker and the second port.

14. Sound reproduction system according to claim 1, wherein the acoustic distance decreases over the frequency range.

15. A processing circuit for applying a first electrical signal to a first loudspeaker mounted with a second loudspeaker on a wall of a loudspeaker enclosure having a first volume and a second volume separated by a partition, respectively receiving the first loudspeaker and the second loudspeaker, and each respectively communicating with a first port and a second port situated on respective opposite sides of the combination formed by the first loudspeaker and the second loudspeaker, the processing circuit comprising:

a processing means for applying respectively to the first loudspeaker and to the second loudspeaker a first electrical signal and a second electrical signal obtained from a same signal by differentiated phase processing varying with frequency, the processing means for generating between the first electrical signal and the second electrical signal a delay varying with frequency and proportional to the acoustic distance between the first half-enclosure, including the first volume, the first loudspeaker and the first port, and the second half-enclosure, including the second volume, the second loudspeaker and the second port, wherein the acoustic distance is larger than a first distance between the first loudspeaker and the second loudspeaker and smaller than a second distance between the first port and the second port over a frequency range from a tuned frequency of the first and second ports to a contribution limit frequency of the first and second loudspeakers.

16. The processing circuit according to claim 15, wherein the processing means selectively apply an identical electrical signal to the first loudspeaker and the second loudspeaker in a first operating mode and the first electrical signal and the second electrical signal obtained by differentiated processing in a second operating mode.

17. Processing circuit according to claim 15, wherein the processing means include a filter the phase transfer function of which is such that it generates a delay varying with frequency and substantially corresponding to the acoustic distance between the first half-enclosure, including the first volume, the first loudspeaker and the first port, and the second half-enclosure, including the second volume, the second loudspeaker and the second port.

18. Processing circuit according to claim 16, wherein the processing means include a filter the phase transfer function of which is such that it generates a delay varying with frequency and substantially corresponding to the acoustic distance between the first half-enclosure, including the first volume, the first loudspeaker and the first port, and the second half-enclosure, including the second volume, the second loudspeaker and the second port.

* * * * *

UNITED STATES PATENT AND TRADEMARK OFFICE

CERTIFICATE OF CORRECTION

PATENT NO. : 8,391,510 B2
APPLICATION NO. : 12/670214
DATED : March 5, 2013
INVENTOR(S) : Eric Vincenot It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 210 days.

Signed and Sealed this
First Day of September, 2015

Michelle K. Lee

Michelle K. Lee
*Director of the United States Patent and Trademark Office*